US011161361B2

(12) United States Patent
Jiang

(10) Patent No.: US 11,161,361 B2
(45) Date of Patent: Nov. 2, 2021

(54) INKJET PRINTER AND ECCENTRIC WHEEL THEREOF

(71) Applicant: SHENZHEN RUNTIANZHI DIGITAL EQUIPMENT CO., LTD., Guangdong (CN)

(72) Inventor: Hong Jiang, Guangdong (CN)

(73) Assignee: SHENZHEN RUNTIANZHI DIGITAL EQUIPMENT CO., LTD., Guangdong (CN)

( * ) Notice: Subject to any disclaimer, the term of this patent is extended or adjusted under 35 U.S.C. 154(b) by 729 days.

(21) Appl. No.: 16/062,871

(22) PCT Filed: Jul. 25, 2017

(86) PCT No.: PCT/CN2017/094240
§ 371 (c)(1),
(2) Date: Jun. 15, 2018

(87) PCT Pub. No.: WO2018/120804
PCT Pub. Date: Jul. 5, 2018

(65) Prior Publication Data

US 2021/0162785 A1 Jun. 3, 2021

(30) Foreign Application Priority Data

Dec. 28, 2016 (CN) ..... 201611238914.7
Dec. 28, 2016 (CN) ..... 201621463560.1

(51) Int. Cl.
*B41J 29/38* (2006.01)
*B41J 29/02* (2006.01)

(52) U.S. Cl.
CPC ..... *B41J 29/38* (2013.01); *B41J 29/02* (2013.01)

(58) Field of Classification Search
CPC ..... B41J 29/38; B41J 29/02
See application file for complete search history.

(56) References Cited

U.S. PATENT DOCUMENTS

2004/0061741 A1* 4/2004 Aschoff ..... B41J 2/1637 347/49
2006/0290725 A1* 12/2006 Akahane ..... B41J 2/2135 347/9

(Continued)

FOREIGN PATENT DOCUMENTS

CN 101391537 A 3/2009
CN 101905574 A 12/2010

(Continued)

OTHER PUBLICATIONS

International Search Report for PCT/CN2017/094240 dated Oct. 26, 2017, ISA/CN.

*Primary Examiner* — Jason S Uhlenhake
(74) *Attorney, Agent, or Firm* — Yue (Robert) Xu; Apex Attorneys at Law, LLP

(57) ABSTRACT

An eccentric wheel and an inkjet printer including the eccentric wheel are provided. The eccentric wheel includes two groups of eccentric wheel bodies, mounted on a base of a trolley and configured to drive a print head to move backward and forward and move leftward and rightward in a print head groove. A distance from an outer edge to a rotation center of each of the eccentric wheel bodies is gradually changed. The outer edge of each of the eccentric wheel bodies is in contact with a side edge of the print head. One group of the eccentric wheel bodies are arranged in a forward and backward movement direction of the print head, and the other group of the eccentric wheel bodies are arranged in a leftward and rightward movement direction of the print head.

8 Claims, 3 Drawing Sheets

(56) References Cited

U.S. PATENT DOCUMENTS

| | | | |
|---|---|---|---|
| 2010/0309263 | A1 | 12/2010 | Huang |
| 2012/0118181 | A1 | 5/2012 | Iwanabe et al. |
| 2013/0070023 | A1 | 3/2013 | Ohashi et al. |
| 2015/0077462 | A1 | 3/2015 | Suzuki |
| 2016/0236490 | A1 | 8/2016 | Masanobu et al. |
| 2016/0332442 | A1 | 11/2016 | Yamabe |

FOREIGN PATENT DOCUMENTS

| | | | | |
|---|---|---|---|---|
| CN | 102166883 | A | | 8/2011 |
| CN | 102649354 | A | | 8/2012 |
| CN | 202463121 | U | | 10/2012 |
| CN | 104442004 | A | | 3/2015 |
| CN | 205149228 | U | | 4/2016 |
| CN | 105579233 | A | | 5/2016 |
| CN | 106626819 | A | | 5/2017 |
| JP | 2011136507 | A | * | 7/2011 |
| JP | 2012108974 | A | | 6/2012 |
| JP | 2016215421 | A | | 12/2016 |

* cited by examiner

INKJET PRINTER AND ECCENTRIC WHEEL THEREOF

The present application is the national phase of International Patent Application No. PCT/CN2017/094240 filed on Jul. 25, 2017, which claims priorities to Chinese Patent Application No. 201611238914.7, titled "INKJET PRINTER AND ECCENTRIC WHEEL THEREOF", filed on Dec. 28, 2016 with the State Intellectual Property Office of People's Republic of China, and Chinese Patent Application No. 201621463560.1, titled "INKJET PRINTER AND ECCENTRIC WHEEL THEREOF", filed on Dec. 28, 2016 with the State Intellectual Property Office of People's Republic of China, all of which are incorporated herein by reference in their entireties.

FIELD

The present disclosure relates to the technical field of digital printing, in particular to an eccentric wheel. The present disclosure also relates to an inkjet printer including the eccentric wheel.

BACKGROUND

An inkjet printer, as a large-scale printer, has a definition lower than an imprinter or a true color printer. However, an inkjet printer currently available has a greatly improved definition. A solvent-based ink or a UV-curable ink is used in the inkjet printer. The solvent-based ink has strong odor and corrosiveness. During a printing process, the solvent-based ink penetrates into an interior of a printing material through corrosion, such that printed images are not easily discolored. Thus the images have characteristics of water resistance, anti-ultraviolet, anti-scratch and the like.

In a conventional inkjet printer, a print head is mounted on a base, the base is mounted in a print head groove on a trolley bottom plate, and the base is provided with screws. The print head is moved forward and backward or moved leftward and rightward in the print head groove by means of adjustment of the screws, resulting in an inconvenient adjustment, a difficult control, an inflexible movement and an inaccurate position of the print head. Therefore it is inconvenient and difficult to use the inkjet printer to move the print head to a desired position to complete mechanical color register.

Therefore, it is desired for those skilled in the art to effectively solve the problem of inconvenient adjustment and difficult control of movement of the print head in the print head groove.

SUMMARY

An object of the present disclosure is to provide an eccentric wheel, with which the problem of inconvenient adjustment and difficult control of the movement of the print head in the print head groove is effectively solved. Another object of the present disclosure is to provide an inkjet painter including the eccentric wheel.

In order to solve the above technical problem, the following technical solutions are provided according to the present disclosure.

An eccentric wheel of an inkjet printer is provided, which includes two groups of eccentric wheel bodies mounted on a base of a trolley and configured to drive the print head to move backward and forward and move leftward and rightward in the print head groove. A distance from an outer edge to a rotation center of each of the eccentric wheel bodies is gradually changed. The outer edge of each of the eccentric wheel bodies is in contact with a side edge of the print head. One group of the eccentric wheel bodies are arranged in a forward and backward movement direction of the print head, and the other group of the eccentric wheel bodies are arranged in a leftward and rightward movement direction of the print head.

Preferably, a maximum eccentric amount position, a minimum eccentric amount position and a rotation center of each of the eccentric wheel bodies are located in a same straight line, and a curvature radius of the eccentric wheel body gradually increases from the minimum eccentric amount position to the maximum eccentric amount position.

Preferably, a notch is provided at each of the maximum eccentric amount position and the minimum eccentric amount position of each of the eccentric wheel bodies.

Preferably, a marking hole is provided on an upper surface of the notch at the maximum eccentric amount position of each of the eccentric wheel bodies.

Preferably, each of the eccentric wheel bodies is mounted on the base, the base and the eccentric wheel body are provided with a through hole at the rotation center, and the base is fixed with a trolley bottom plate by a screw passing through the through hole.

Preferably, each of the eccentric wheel bodies is a stainless steel wheel.

An inkjet printer is further provided according to the present disclosure, which includes a trolley bottom plate, a print head arranged on the trolley bottom plate and an eccentric wheel configured to drive the print head to move. The eccentric wheel is any eccentric wheel as described above.

The eccentric wheel of the inkjet printer according to the present disclosure includes two groups of eccentric wheel bodies mounted on the base of the trolley. One group of the eccentric wheel bodies drive the print head to move backward and forward in the print head groove, and another group of the eccentric wheel bodies drive the print head to move leftward and rightward in the print head groove. The number of the eccentric bodies in each group is not limited, that is, each group may include one eccentric wheel body or multiple eccentric wheel bodies arranged in parallel. The number of the eccentric wheel bodies in each group may be determined according to actual situations. A distance from an outer edge to a rotation center of the eccentric wheel body is gradually changed, that is, the distance has a minimum value and a maximum value. The outer edge of the eccentric wheel body is in contact with a side edge of the print head. One group of the eccentric wheel bodies are arranged in a forward and backward movement direction of the print head, and the other group of the eccentric wheel bodies are arranged in a leftward and rightward movement direction of the print head. In a mechanical color register operation, the print head is moved backward and forward or moved leftward and rightward in the print head groove by rotating the eccentric wheel body to generate a resist force to the print head and a rebound force to the print head, for example, by a print head presser, such that the print head is moved to a desired position to complete the mechanical color register of the print head.

With the eccentric wheel of the inkjet printer according to the present disclosure, a circular motion of the eccentric wheel body is transformed into a linear motion of the print head, and thus a position of the print head is adjusted microscopically based on a change of an eccentric amount of the eccentric wheel body. Therefore, it is easy to move the print head to a desired position to complete the mechanical color register of the print head, thereby achieving a high adjustment accuracy, an easy operation, a convenient control. In this way, the print head can be moved flexibly, thus resulting in convenient use of the inkjet printer. In addition, an overall structure is simple, which leads to easy manufacture and assembly, and a low cost.

An inkjet printer is further provided according to the present disclosure, which includes a trolley bottom plate, a print head arranged on the trolley bottom plate and an eccentric wheel configured to drive the print head to move. The eccentric wheel is any eccentric wheel as described above. Since the above-described eccentric wheel achieves the above technical effect, the inkjet printer with the eccentric wheel achieves the technical effect accordingly.

BRIEF DESCRIPTION OF THE DRAWINGS

In order to more clearly describe the technical solution in the embodiments of the present disclosure or the technical solution in the conventional technology, drawings to be used in the embodiments of the present disclosure or in the conventional technology are briefly described hereinafter. It is apparent that the drawings described below show merely some embodiments of the present disclosure, and those skilled in the art may obtain other drawings according to the provided drawings without any creative effort.

In the drawings.

Figure 1:
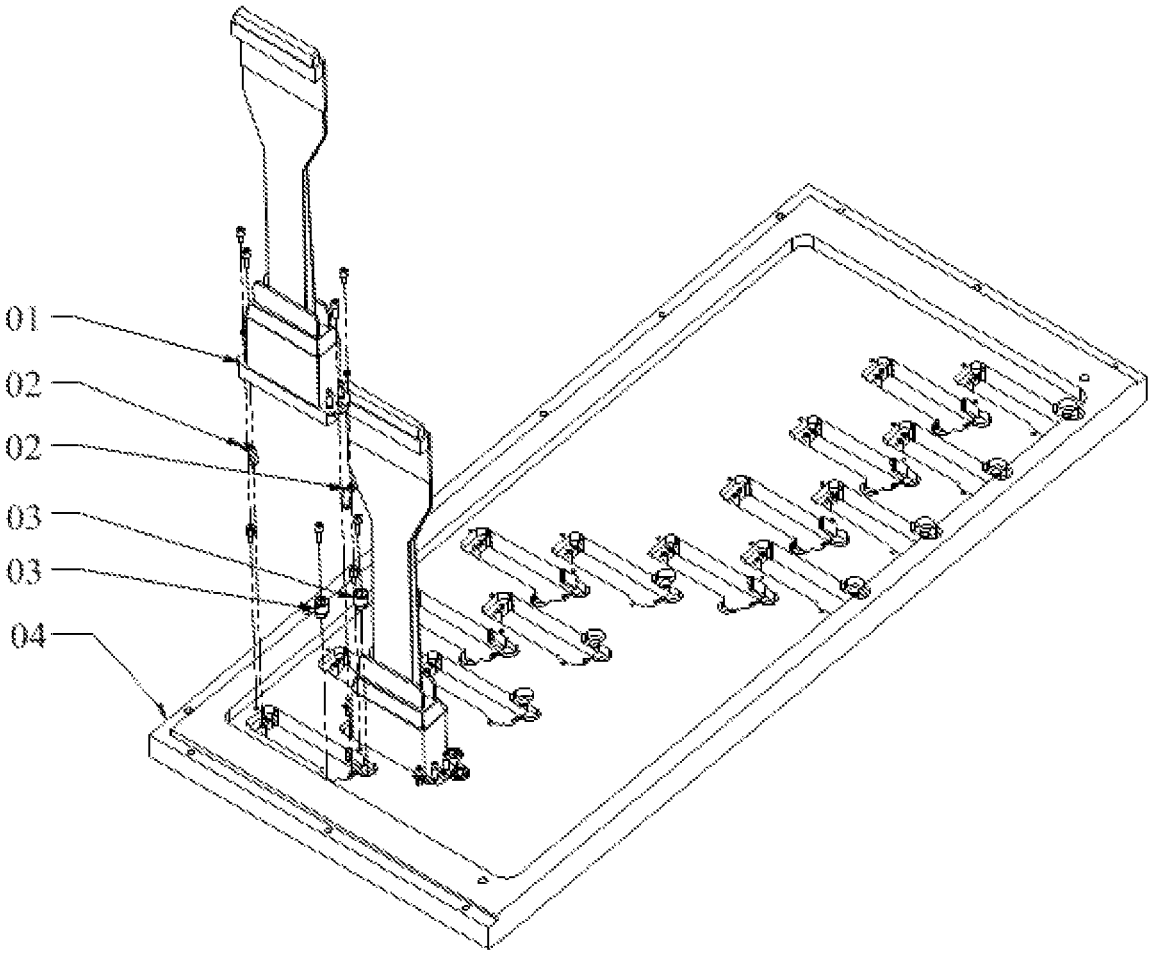
FIG. 1 is a structural diagram of a trolley in an inkjet printer according to an embodiment of the present disclosure.

01 Print head
02 Print head presser
03 Eccentric wheel
04 Trolley bottom plate
1 Notch
2 Maximum eccentric amount position
3 Marking hole
4 Through hole
5 Minimum eccentric amount position

DETAILED DESCRIPTION

The kernel of the present disclosure is to provide an eccentric wheel, with which the problem of inconvenient adjustment and difficult control of movement of the print head in the print head groove is effectively solved. Another kernel of the present disclosure is to provide an inkjet printer including the eccentric wheel.

The technical solutions in the embodiments of the present disclosure are described clearly and completely in conjunction with the accompanying drawings in the embodiments of the present disclosure hereinafter. It is apparent that the below-described embodiments are merely some rather than all of embodiments of the present disclosure. All other embodiments obtained by those skilled in the art based on the embodiments in the present disclosure without any creative work should fall within the protection scope of the present disclosure.

Figure 2:
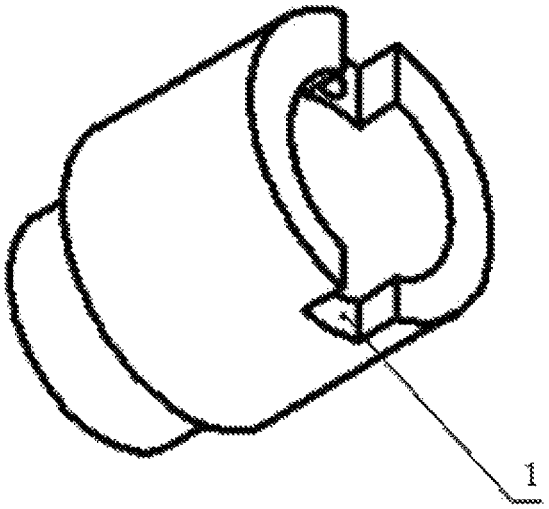
FIG. 2 is a schematic structural diagram of an eccentric wheel in FIG. 1.
Figure 3:
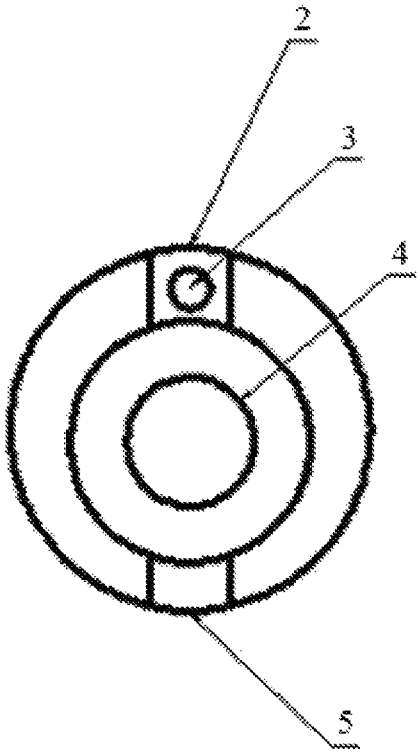
FIG. 3 is a top view of FIG. 2.

Reference is made to FIG. 1 to FIG. 3. FIG. 1 is a structural diagram of a trolley in an inkjet printer according to an embodiment of the present disclosure. FIG. 2 is a schematic structural diagram of an eccentric wheel in FIG. 1. FIG. 3 is a top view of FIG. 2.

In a specific embodiment, an eccentric wheel of an inkjet printer according to the present disclosure includes two groups of eccentric wheel bodies mounted on a base of a trolley. One group of the eccentric wheel bodies drive a print head 01 to move backward and forward in a print head groove, and the other group of the eccentric wheel bodies drive the print heads 01 to move leftward and rightward in the print head groove. The number of the eccentric bodies in each group is not limited, that is, each group may include one eccentric wheel body or multiple eccentric wheel bodies arranged in parallel. The number of the eccentric wheel bodies in each group may be determined according to actual situations. A distance from an outer edge to a rotation center of the eccentric wheel body is gradually changed, that is, the distance has a minimum value and a maximum value. The outer edge of the eccentric wheel body is in contact with a side edge of the print head 01. One group of the eccentric wheel bodies are arranged in a forward and backward movement direction of the print head 01, and the other group of the eccentric wheel bodies are arranged in a leftward and rightward movement direction of the print head 01. In a mechanical color register operation, the print head 01 is moved backward and forward or moved leftward and rightward in the print head groove by rotating the eccentric wheel body to generate a resist force to the print head 01 and a rebound force to the print head 01, for example, a rebound force of a print head presser 02, such that the print head 01 is moved to a desired position to complete the mechanical color register of the print head 01.

With the eccentric wheel of the inkjet printer according to the present disclosure, a circular motion of the eccentric wheel body is transformed into a linear motion of the print head 01, and thus a position of the print head 01 is adjusted microscopically based on a change of an eccentric amount of the eccentric wheel body. Therefore, it is easy to move the print head 01 to a desired position to complete the mechanical color register of the print head 01, thereby achieving a high adjustment accuracy, an easy operation, and a convenient control. In this way, the print head 01 can be moved flexibly, thus realizing convenient use of the inkjet printer. In addition, an overall structure is simple, which leads to easy manufacture and assembly, and a low cost.

The above-described eccentric wheel is only a preferred embodiment, and the present disclosure is not limited thereto. Different embodiments can be obtained based on the preferred embodiment through specific modifications according to actual needs. A maximum eccentric amount position 2 and a minimum eccentric amount position 5 and a rotation center of the eccentric wheel body are located in a same straight line, that is, the three positions are collinear. The curvature radius of the eccentric wheel body gradually increases from the minimum eccentric amount position 5 to the maximum eccentric amount position 2. Therefore, by adjusting in a range between the minimum eccentric position 5 and the maximum eccentric position 2, the print head 01 is moved to a desired position to complete the mechanical color register of the print head 01. The curvature radius of the eccentric wheel body may gradually increase along both sides, and thus both sides can be used to drive. Therefore, it is more convenient to use the eccentric wheel because it can be avoid that the print head 01 cannot be driven due to a wrong rotation direction. The change trends on the two sides may be the same or may be different, and a magnitude of the eccentric amount may be determined according to actual situations.

Based on the above embodiment, those skilled in the art can make several changes to the eccentric wheel according to actual situations. For example, the eccentric wheel body is provided with notches 1 at both the maximum eccentric amount position 2 and the minimum eccentric amount position 5. A tool is inserted into the notch 1, and the eccentric wheel body is rotated by driving the tool. In this way, the eccentric wheel 03 can be rotated with a convenient operation. However, the scheme where the notches 1 are arranged at the maximum eccentric amount position 2 and the minimum eccentric amount position 5 of the eccentric wheel body is only a preferred embodiment rather than an only embodiment. The notch 1 may be arranged in another suitable position, such as a middle position between the maximum eccentric amount position 2 and the minimum eccentric amount position 5. The number of the notches 1 may be one, to have a simple structure. The number of the notches 1 may also be two, and the two notches 1 may be located in a same straight line, to rotate the eccentric wheel body in balance. Also, the two notches 1 may not be located in a same straight line, and positions of the two notches 1 are not limited herein, which are all within the protection scope of the present disclosure.

It is apparent that several changes may be made to the above-described embodiment by those skilled in the art according to actual situations based on the above idea. For example, a marking hole 3 is provided on an upper surface of the notch 1 at the maximum eccentric amount position 2 of the eccentric wheel body. The marking hole 3 is used to mark an eccentric direction of the eccentric wheel 03, such that it is convenient to determine the position of the eccentric wheel 03, so as to better drive the eccentric wheel 03 and reduce misoperations. The marking hole 3 may also be located in the minimum eccentric amount position 5 of the eccentric wheel body, or other position which is identified easily.

It is noted that the eccentric wheel provided according to the present disclosure is not limited to this situation. The eccentric wheel body is mounted on the base and can be rotated with respect to the base. The base and the eccentric wheel body are provided with a through hole 4 at the rotation center. The base is fixed with the trolley bottom plate 04 by a screw passing through the through hole 4, thereby achieving a simple operation, an easy fixing and a convenient disassembly.

In an eccentric wheel according to the present disclosure, without changing other components of the eccentric wheel, the eccentric wheel body is a stainless steel wheel, such as a stainless steel SUS304 wheel, thereby preventing the eccentric wheel body from rusting and wearing. Therefore, the eccentric amount is not affected during the use of the eccentric wheel, such that the eccentric wheel body is rotated accurately and the position of the print head 01 is located accurately.

Based on the eccentric wheel according to the above embodiment, an inkjet printer is further provided according to the present disclosure. The inkjet printer includes a trolley bottom plate 04, a print head 01 arranged on the trolley bottom plate 04, and an eccentric wheel 03 configured to drive the print head 01 to move. The eccentric wheel 03 is any eccentric wheel 03 according to the embodiments above. Since the inkjet printer has the eccentric wheel 03 in the above embodiments, the inkjet printer has the advantageous effects as described in the above embodiments.

In the description of the present disclosure, it should be noted that the positions or positional relationships indicated by the terms "front", "rear", "left", "right", and the like only refer to positions or positional relationships based on illustrations in the drawings, and are merely for convenience and simplicity of the description, rather than indicating or implying that the referred device or an element only has the particular orientation, or only is constructed and operated in the particular orientation, Therefore the description should not be construed as a limitation to the present disclosure.

The embodiments in the specification are described in a progressive manner, and each embodiment focuses on differences from other embodiments. The embodiments can be referred to each other for the same or similar parts.

The above description of the disclosed embodiments enables those skilled in the art to implement or use the present disclosure. Various modifications to these embodiments are readily apparent to those skilled in the art, and the general principles defined herein may be applied to other embodiments without departing from the spirit or scope of the present disclosure. Thus, the present disclosure is not be limited to the embodiments shown herein but is comply with the widest scope consistent with the principles and novel features disclosed herein.

The invention claimed is:

1. An eccentric wheel of an inkjet printer, comprising:

two groups of eccentric wheel bodies, mounted on a base of a trolley and configured to drive a print head to move backward and forward and move leftward and rightward in a print head groove, wherein a distance from an outer edge to a rotation center of each of the eccentric wheel bodies is gradually changed, the outer edge of each of the eccentric wheel bodies is in contact with a side edge of the print head; and one group of the eccentric wheel bodies are arranged in a forward and backward movement direction of the print head, and the other group of the eccentric wheel bodies are arranged in a leftward and rightward movement direction of the print head;

wherein in each of the eccentric wheel bodies, a maximum eccentric amount position, a minimum eccentric amount position and a rotation center of the eccentric wheel body are located in a same straight line; and a curvature radius of the eccentric wheel body gradually increases from the minimum eccentric amount position to the maximum eccentric amount position;

wherein a notch is provided at each of the maximum eccentric amount position and the minimum eccentric amount position of each of the eccentric wheel bodies.

2. The eccentric wheel according to claim 1, wherein a marking hole is provided on an upper surface of the notch at the maximum eccentric amount position of each of the eccentric wheel bodies.

3. The eccentric wheel according to claim 1, wherein each of the eccentric wheel bodies is mounted on the base, the base and the eccentric wheel body are provided with a through hole at the rotation center, and the base is fixed with a trolley bottom plate by a screw passing through the through hole.

4. The eccentric wheel according to claim 1, wherein each of the eccentric wheel bodies is a stainless steel wheel.

5. An inkjet printer comprising:

a trolley bottom plate, a print head arranged on the trolley bottom plate, and an eccentric wheel comprising two groups of eccentric wheel bodies, mounted on a base of a trolley and configured to drive the print head to move backward and forward and move leftward and rightward in a print head groove, wherein a distance from an outer edge to a rotation center of each of the eccentric wheel bodies is gradually changed, the outer edge of each of the eccentric wheel bodies is in contact with a side edge of the print head; and one group of the eccentric wheel bodies are arranged in a forward and backward movement direction of the print head, and the other group of the eccentric wheel bodies are arranged in a leftward and rightward movement direction of the print head;

wherein in each of the eccentric wheel bodies, a maximum eccentric amount position, a minimum eccentric amount position and a rotation center of the eccentric wheel body are located in a same straight line; and a curvature radius of the eccentric wheel body gradually increases from the minimum eccentric amount position to the maximum eccentric amount position;

wherein a notch is provided at each of the maximum eccentric amount position and the minimum eccentric amount position of each of the eccentric wheel bodies.

6. The inkjet printer according to claim 5, wherein a marking hole is provided on an upper surface of the notch at the maximum eccentric amount position of each of the eccentric wheel bodies.

7. The inkjet printer according to claim 5, wherein each of the eccentric wheel bodies is mounted on the base, the base and the eccentric wheel body are provided with a through hole at the rotation center, and the base is fixed with the trolley bottom plate by a screw passing through the through hole.

8. The inkjet printer according to claim 5, wherein each of the eccentric wheel bodies is a stainless steel wheel.

* * * * *